United States Patent [19]

Futaki

[11] 4,354,758

[45] Oct. 19, 1982

[54] EXPOSURE CONTROL DEVICE FOR A PHOTOCOPIER

[75] Inventor: Kenji Futaki, Kawasaki, Japan

[73] Assignee: Tokyo Shibaura Denki Kabushiki Kaisha, Kawasaki, Japan

[21] Appl. No.: 226,806

[22] Filed: Jan. 21, 1981

[30] Foreign Application Priority Data

Jan. 31, 1980 [JP] Japan ..... 55-10234
Jan. 31, 1980 [JP] Japan ..... 55-10235

[51] Int. Cl.[3] ..... G03G 15/00

[52] U.S. Cl. ..... 355/14 E; 355/68; 355/69

[58] Field of Search ..... 355/14 E, 67–69, 355/83, 3 R

[56] References Cited

U.S. PATENT DOCUMENTS 3,743,405 7/1973 Morse et al. ..... 355/68 X
3,926,518 12/1975 Berry et al. ..... 355/68 X
4,124,295 11/1978 Gardiner ..... 355/68
4,153,364 5/1979 Suzuki et al. ..... 355/8 X
4,200,391 4/1980 Sakamoto et al. ..... 355/68 X
4,239,374 12/1980 Tatsumi et al. ..... 355/14 E

*Primary Examiner*—R. L. Moses
*Attorney, Agent, or Firm*—Cushman, Darby & Cushman

[57] ABSTRACT

According to an exposure control device for a photocopier of the present invention, a voltage corresponding to the voltage applied to an exposure lamp is produced by a dummy load circuit and a wave shaper. The light reflected by the manuscript is detected by a photodetector and is converted into a voltage. The output voltage of the wave shaper and the output voltage of the detector are added by an adding switch. The added output voltage and the reference voltage are input to an error amplifier and are compared. The output signal of the error amplifier is input to a trigger pulse generator. The trigger pulse generator supplies a trigger pulse to a thyristor connected to the exposure lamp for controlling the amount of light of the exposure lamp.

7 Claims, 5 Drawing Figures

EXPOSURE CONTROL DEVICE FOR A PHOTOCOPIER

BACKGROUND OF THE INVENTION

The present invention relates to an exposure control device for a photocopier which automatically controls the exposure in an electronic photocopier, for example.

With an electronic photocopier of this type, especially in the case of manuscripts with dark backgrounds such as newspapers and dark blueprints, it is necessary to control to increase the exposure or increase the bias voltage of the developer as compared with general manuscripts. However, such control has conventionally been performed by the operator as the need arises by, for example, operating an exposure adjusting dial or a change-over switch mounted on the control panel. However, such control was defective in that the operation is complex, the operability is inferior, the optimal exposure for various kinds of manuscripts is difficult to determine, and suitable photocopying cannot be constantly performed. A prior art device is disclosed in U.S. Pat. No. 3,926,518 of Berry et al.

This device is an optical scanning system with means for detecting illuminance adjacent to the optical path. The illuminance is adjusted in response to an output signal from the illuminance detecting means. However, this invention does not teach to vary the brightness of the exposure lamp. Furthermore, a particular circuit for the illuminance adjusting means is not disclosed.

In U.S. Pat. No. 3,743,405 of Morse et al, an exposure control device is disclosed which consists of a radiation-sensitive control element. However, this invention does not teach to control the amount of light of the exposure lamp by comparing a reference signal with a voltage sum of a voltage corresponding to a voltage applied to the exposure lamp and a voltage corresponding to the reflected light from the manuscript, unlike in the case of the present invention.

SUMMARY OF THE INVENTION

It is, therefore, the primary object of the present invention to provide an exposure control device for a photocopier which automatically obtains optimal exposure corresponding to variations in the power source voltage for various manuscripts, and according to which the operability is extremely improved.

In order to achieve the above and other objects, the present invention provides an exposure control device for a photocopier which exposes an image by irradiating a manuscript with an exposing lamp and guiding the reflected light to a photosensor comprising: voltage generating means for generating a voltage corresponding to a voltage applied to said exposure lamp; light detecting means for detecting the light reflected from said manuscript for converting it into a voltage signal; means for adding an output voltage of said light detecting means to an output voltage of said voltage generating means; comparing means for comparing a voltage added by said adding means with a reference voltage set in advance, and for outputting a signal corresponding to the compared result; and control means for controlling the amount of light from said exposure lamp according to the output signal from said comparing means.

BRIEF DESCRIPTION OF THE DRAWINGS

Other objects and features of the present invention will be apparent from the following description taken in connection with the accompanying drawings in which.

DETAILED DESCRIPTION OF THE PREFERRED EMBODIMENTS

Figure 1:
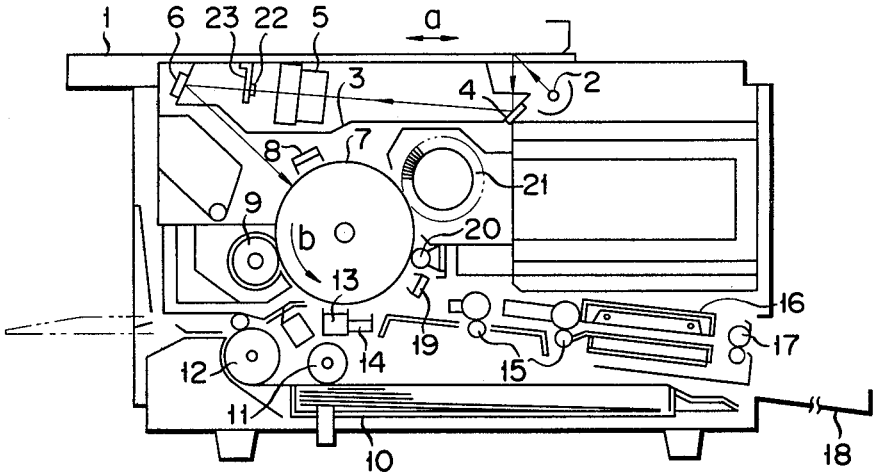
FIG. 1 is a schematic view illustrating the construction of an electronic photocopier according to one embodiment of the present invention.

FIG. 1 schematically shows an electronic photocopier according to the present invention. A manuscript table 1 for receiving a manuscript reciprocates in the direction shown by arrow "a" as required. When the manuscript table 1 moves, the manuscript placed thereon is irradiated by an exposure lamp 2. The reflected light is guided to a photosensitive drum 7 through a mirror 4, a lens mechanism 5, and a mirror 6 supported by an optical block 3. The image of the manuscript is formed on the surface of the photosensitive drum 7. The photosensitive drum 7 first rotates in the direction shown by arrow "b" and is charged by a charger 8. Thereafter, the image of the manuscript is exposed to light, and an electrostatic latent image is formed on the surface of the photosensitive drum 7. This electrostatic latent image is developed when toner is applied by a developer 9. A paper copying sheet inside a cassette is fed by a paper feed roll 11 which operates in response to the rotation of the photosensitive drum 7 and is carried by a carrier roller 12 or the like. The carried paper copying sheet is brought into close contact with the surface of the photosensitive drum 7 by a copying charger 13 which copies the toner image on the photosensitive drum 7. The paper copying sheet is separated after copying from the photosensitive drum 7 by a separating charger 14. The copied image is fixed when fed to a fixer 16 by carrying rollers 15. After the image is fixed thereon, the paper copying sheet is exhausted to a tray 18 by a paper exhaust roller 17. The photosensitive drum 7, after copying, is discharged by a discharger 19, and the electrostatic latent image is erased by a fluorescent lamp 20. The drum 7 is then cleaned by a cleaner 21 and is returned to the initial condition.

A photodetecting element such as a photodiode 22 is disposed in the optical path between the lens mechanism 5 and the mirror 6 inside the optical block 3. This diode 22 is secured to the optical block 3 by a mounting member 23. The photodiode 22 detects part of the light reflected from the manuscript originating from the exposure lamp 2 and converts it into an electric signal. The photodiode 22 constitutes the photodetecting part of a photodetector to be described later (numeral 38 in FIGS. 2 and 3).

Figure 2:
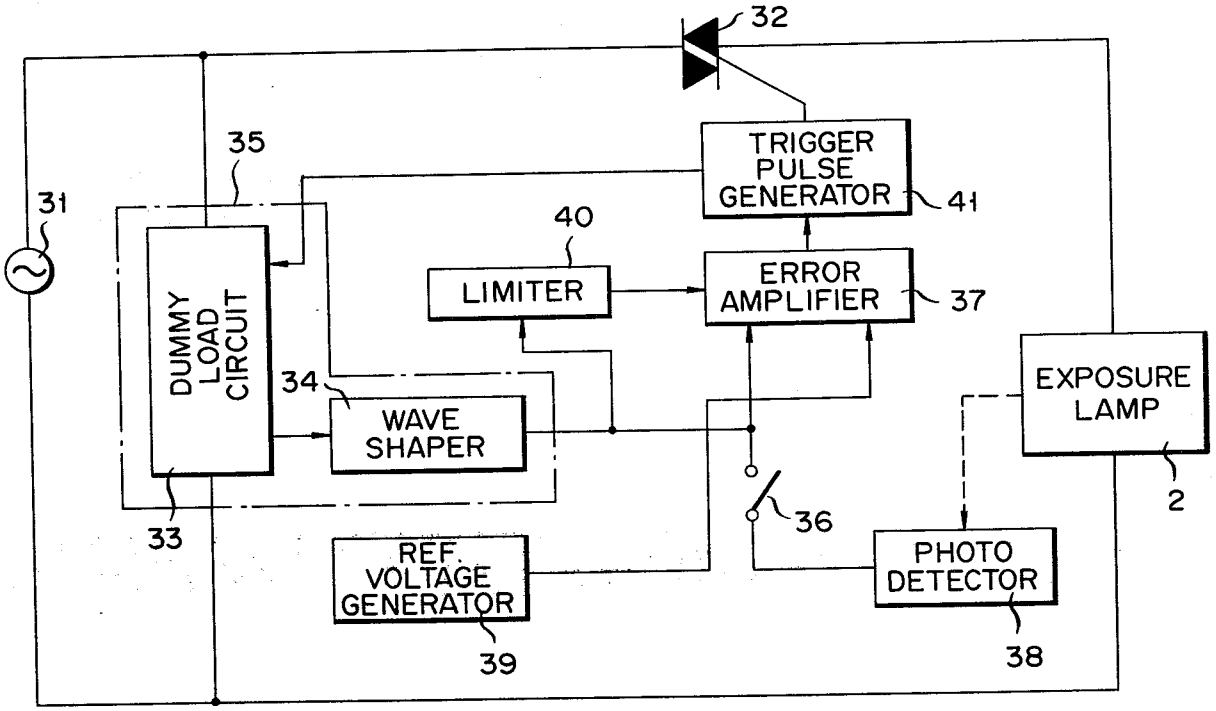
FIG. 2 is a block diagram illustrating the schematic construction of the exposure control device.

FIG. 2 schematically shows the exposure control device of the present invention. The exposure lamp 2 is connected to a commercial AC outlet 31 through a bidirectional triode thyristor 32. A dummy load circuit 33 is connected to the outlet 31. When the thyristor 32 is turned on, a voltage corresponding to a voltage across both ends of the exposure lamp 2 is applied to the dummy load circuit 33 which outputs a voltage across both ends of a dummy load. The output voltage of the dummy load circuit 33 is supplied to a wave shaper 34. The wave shaper 34 shapes the output voltage of the dummy load circuit 33 and outputs a voltage corresponding to the effective voltage of the exposure lamp 2. The dummy load circuit 33 and the wave shaper 34 constitute a voltage generator 35 for generating a voltage corresponding to the applied voltage on the exposure lamp 2. The output voltage of the wave shaper 34 is supplied to a comparator, for example, an error amplifier 37. The output voltage of the photodetector 38 is also supplied to the error amplifier 37 through an adding switch 36. The error amplifier 37 compares a voltage obtained by adding the output voltage of the wave shaper 34 to the output voltage of the photodetector 38 with a reference voltage output from a reference voltage generator 39. When there is an error between the voltages as a result of the comparison, a signal is output corresponding to the error.

The photodetector 38 detects the light reflected from the manuscript and outputs a voltage signal corresponding to the detected light amount. A limiter 40 is connected to the error amplifier 37. The limiter 40 limits the output of the error amplifier 37 when the output voltage of the wave shaper 34 reaches a predetermined value. As a result, the voltage applied to the exposure lamp 2 is controlled not to exceed the rated voltage. The output signal of the error amplifier 37 is supplied to a trigger pulse generator 41. The trigger pulse generator 41 outputs a trigger pulse which is in synchronism with the frequency of the outlet 31 and controls the generating phase of the trigger pulse in response to the output signal from the error amplifier 37. The trigger pulse controlled by the trigger pulse generator is supplied to the gate of the thyristor 32.

The mode of operation of the embodiment of the present invention of the above construction will now be described.

A case will first be described wherein the adding switch 36 is turned off. When there is an error between the output voltage of the wave shaper 34 and the reference voltage of the reference voltage generator 39, the output voltage of the error amplifier 37 increases or decreases according to the magnitude of the error. The generating phase of the trigger pulse output from the trigger pulse generator 41 also changes according to this. Consequently, the conduction angle of the thyristor 32 changes. This change is fed back to the error amplifier 37 by the trigger pulse to the dummy load circuit 33. Thus, the output voltage of the wave shaper 34 is so controlled that the output voltage of the wave shaper 34 equals the reference voltage of the reference voltage generator 39, that is, the voltage applied across the ends of the exposure lamp 2 is constant regardless of changes in the voltage at the outlet 31. The limiter 40 detects the output voltage of the wave shaper 34 and controls the output of the error amplifier 37 when this output voltage exceeds a predetermined value. A case will now be described wherein the adding switch 36 is turned on. In this case, the exposure lamp 2 is controlled by the output voltages of the voltage generating circuit 35 and the photodetector 38. The light emitted by the exposure lamp 2 is reflected by the manuscript and becomes incident on the photodetector 38. The photodetector 38 outputs a voltage according to the amount of incident light. This output voltage is supplied to the error amplifier 37 through the adding switch 36. The voltage generating circuit 35 outputs a predetermined voltage to the voltage according to the above-mentioned operation. Thus, the output voltage of the photodetector 38 is supplied to the error amplifier 37 after being added to the output voltage of the voltage generating circuit 35. It is assumed that the output voltage of the photo-detector 38 is low when the intensity of incident light is low. In the case of a dark manuscript, the amount of incident light on the photodetector 38 is also low.

Therefore, the output voltage of the photodetector 38 is also low. When it is assumed that the output voltage of the photodetector 38 is lower than the reference voltage of the reference voltage generator 39, the error amplifier 37 amplifies the error and outputs it to the trigger pulse generator 41. As a result, the trigger pulse generator 41 controls the thyristor 32 so that its conduction angle is greater. The amount of light of the exposure lamp 2 thus increases. The amount of light of the exposure lamp 2 is detected by the photodetector 38 again. Its output voltage is compared with the reference voltage after being added to the output voltage of the voltage generating circuit 35 and is balanced when the added voltage equals the reference voltage. When the voltage of the outlet 31 varies under this condition, the voltage to be applied to the exposure lamp 2 is controlled to be constant. In this manner, the voltage applied to the exposure lamp 2 is controlled to be constant and the amount of light reflected from the manuscript is controlled to be constant. Thus, optimal exposure may be obtained regardless of the variation in the power source voltage and the darkness of the manuscript. Further, it is possible to compensate for the effect of variation of the power source voltage on the exposure by detecting the light reflected from the manuscript.

Figure 3A:
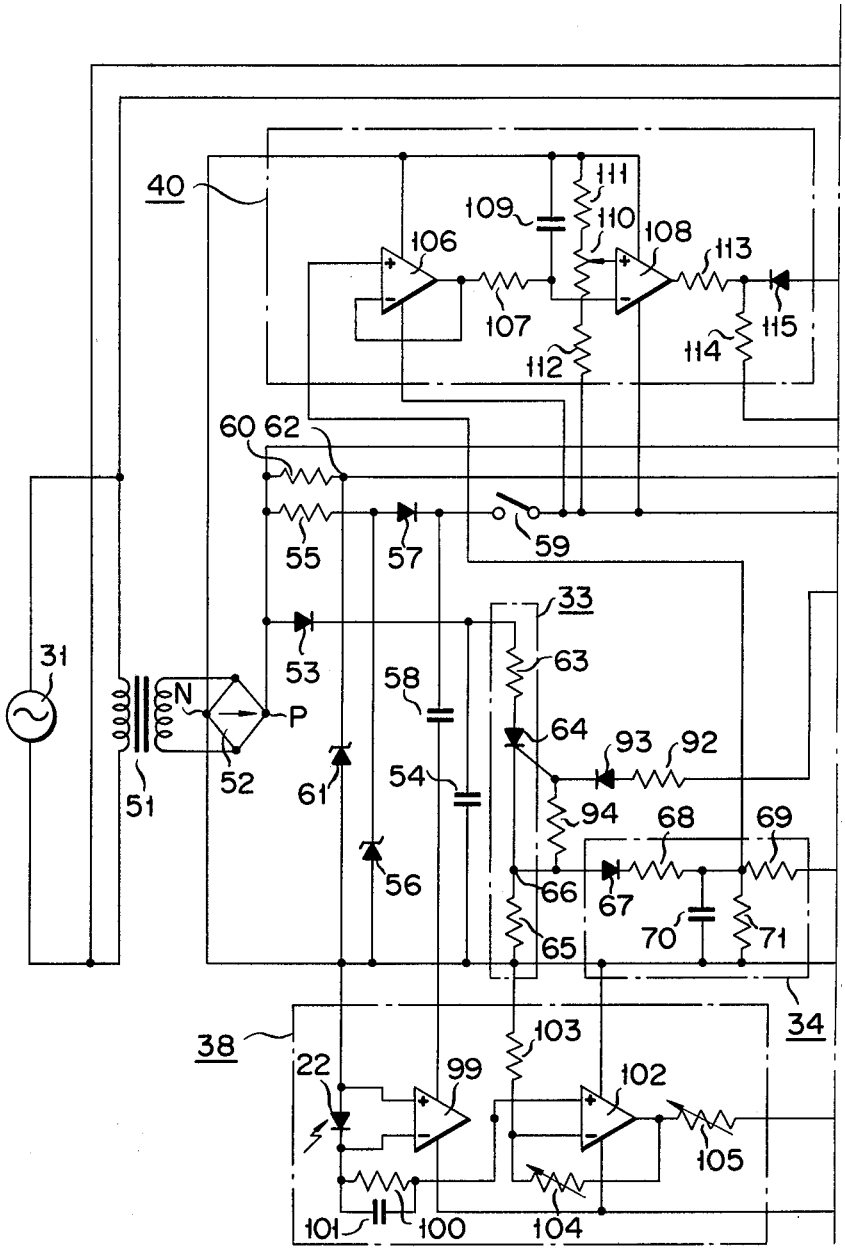
FIGS. 3A and 3B are views illustrating the particular constructions of the respective circuits of the exposure control device shown in FIG. 2.
Figure 3B:
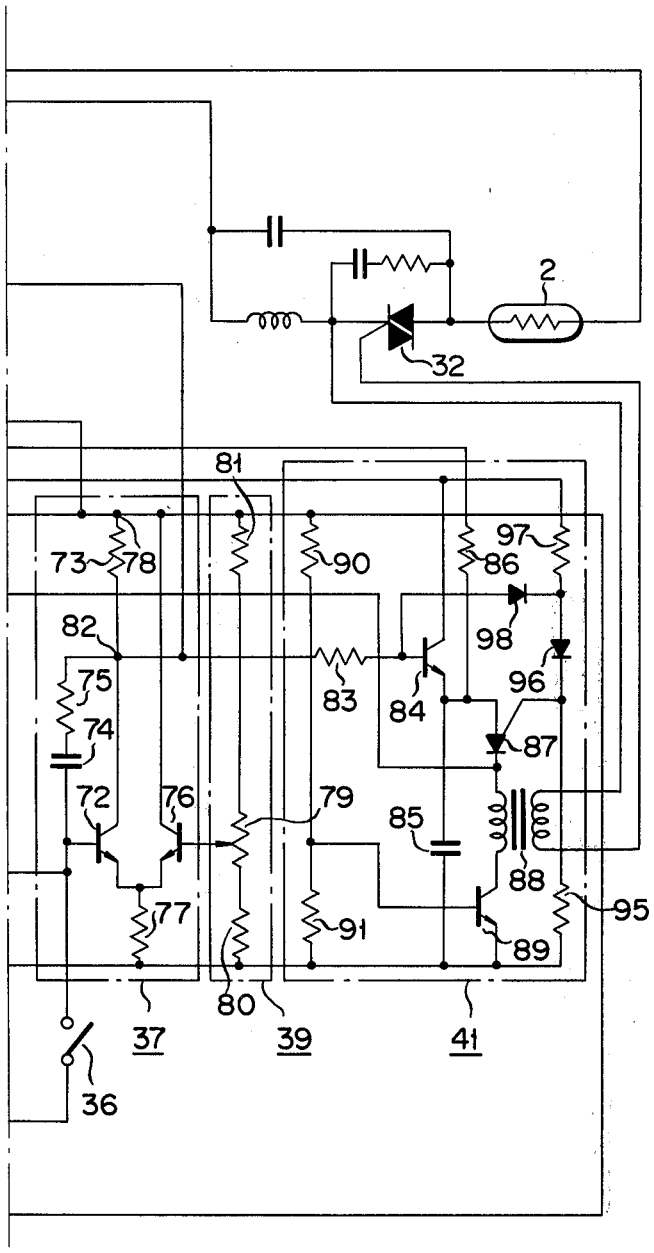

FIGS. 3A and 3B are circuit diagrams of the exposure control device of FIG. 2. The primary coil of a power source transformer 51 is connected to the outlet 31. A full-wave rectifier 52 is connected to the secondary coil of the power source transformer 51. A series circuit consisting of a diode 53 and a capacitor 54 is connected between the DC output ends P and N of the rectifier 52. A series circuit consisting of a resistor 55 and a Zener diode 56 is connected between the above-mentioned output ends P and N. A series circuit consisting of a diode 57 and a capacitor 58 is connected to the diode 56.

The node of the diode 57 and the capacitor 58 is connected to one end of the switch 59. A series circuit consisting of a resistor 60 and a Zener diode 61 is connected between the above-mentioned output ends P and N. A trapezoidal wave voltage in synchronism with the outlet 31 is induced across a node 62 of the resistor 60 and the diode 61. The dummy load circuit 33 is connected in parallel to the capacitor 54. A series circuit consisting of a resistor 63, a unidirectional thyristor 64, and a dummy load resistor 65 constitute the dummy load circuit 33. The output of the dummy load circuit 33 is obtained from a node 66 of the cathode of the thyristor 64 and the resistor 65. This node 66 is connected to one end of the adding switch 36 through a series circuit of a diode 67 and resistors 68 and 69. A capacitor 70 and a resistor 71 are connected in parallel between the node of the resistors 68 and 69 and the output end N. The diode 67, the resistors 68, 69 and 71, and the capacitor 70 constitute the wave shaper 34. The node of one end of the adding switch 36 and the resistor 69 is connected to the base of an npn transistor 72. The collector of the transistor 72 is connected to the other end of the switch 59 through the resistor 73. A series circuit of an oscillation-preventing capacitor 74 and a resistor 75 is connected between the base and the collector of the transistor 72. The emitter of the transistor 72 is connected commonly with the emitter of an npn transistor 76. The common node is connected to the output end N through a resistor 77. The collector of the transistor 76 is connected to the node of the switch 59 and the resistor 73, and the base is connected to a slider of a variable resistor 79. One end of the variable resistor 79 is connected to the output end N through a resistor 80 and the other end is connected to the above-mentioned node through a resistor 81. The transistors 72 and 76, the resistors 73, 75 and 77, and the capacitor 74 constitute the error amplifier 37. The variable resistor 79 and the resistors 80 and 81 constitute the reference voltage generator 39.

A node 82 of the collector of the transistor 72 and the resistor 73 is the output end of the error amplifier 37. This node 82 is connected to the base of an npn transistor 84 through a resistor 83. The collector of the transistor 84 is connected to the node 62. The emitter of the transistor 84 is connected to the output end N through a capacitor 85. The emitter of the transistor 84 is connected to the output end P through a resistor 86, as well as to the anode of a programmable unijunction transistor (PUT) 87. The cathode of the PUT 87 is connected to the output end N through a series circuit consisting of the primary coil of a pulse transformer 88 and an npn transistor 89. The base of the transistor 89 is connected to the node 78 through a resistor 90 as well as to the output end N through a resistor 91. The cathode of the PUT 87 is connected to the gate of the thyristor 64 through a series circuit consisting of a resistor 92 and a diode 93. The gate of the thyristor 64 is connected to the node 66 through a resistor 94. The secondary coil of the pulse transformer 88 is connected between the gate and the first anode of the thyristor 32. The gate of the PUT 87 is connected to the output end N through a resistor 95 as well as to the node 62 through a series circuit of a diode 96 and a resistor 97. The node of the diode 96 and the resistor 97 is connected to the base of the transistor 84 through a diode 98. The transistors 84 and 89, the PUT 87, the pulse transformer 88, the capacitor 85, the diodes 96 and 98, and the resistors 83, 86, 90, 91, 95 and 97 constitute the pulse generator 41.

The anode of the photodiode 22 is connected to the output end N as well as to the non-inverting input terminal of an operational amplifier 99. The cathode of the diode 22 is connected to the inverting input terminal of the operational amplifier 99 as well as to the output end of the operational amplifier 99 through a parallel-connected feedback resistor 100 and a capacitor 101. The output end of the operational amplifier 99 is connected to the non-inverting input terminal of an operational amplifier 102. The inverting input terminal of the operational amplifier 102 is connected to the output end N through a resistor 103 as well as to the output end of the operational amplifier 102 through a feedback variable resistor 104. The output end of the operational amplifier 102 is connected to the other end of the adding switch 36 through a variable resistor 105. The photodiode 22, the operational amplifiers 99 and 102, the resistors 100 and 103, the variable resistors 104 and 105, and the capacitor 101 constitute the photodetector 38. The output end of the wave shaper 34, that is, the node of the resistors 68 and 69, is connected to the non-inverting input terminal of an operational amplifier 106. The inverting input terminal of the operational amplifier 106 is connected to its own output end. The output end of the operational amplifier 106 is connected to the inverting input terminal of another operational amplifier 108 through a resistor 107. This node is connected to the output end N through a smoothing capacitor 109. The non-inverting input terminal of the operational amplifier 108 is connected to the slider of a variable resistor 110 for setting the reference voltage. One end of the variable resistor 110 is connected to the output end N through a resistor 111 and the other end is connected to the node 78 through a resistor 112. The output end of the operational amplifier 108 is connected to the node 78 through a series circuit consisting of resistors 113 and 114. The node of the resistors 113 and 114 is connected to the node 82 through a diode 115. The operational amplifiers 106 and 108, the variable resistor 110, the diode 115, the resistors 107, 111, 112, 113 and 114 and the capacitor 109 constitute the limiter 40.

The mode of operation of the exposure control device of the above construction will be described. A case is first considered wherein the adding switch 36 is set to off. In this case, the photodetector 38 is dissociated from the exposure lamp control to be described below. When the switch 59 is turned on, a voltage obtained by dividing the voltage across the node 78 by the resistors 90 and 91 is applied to the base of the transistor 89, and the transistor 89 is rendered conductive. A voltage across the node 78 is applied to the base of the transistor 84 through the resistors 73 and 83, and the transistor 84 is rendered conductive. The capacitor 85 is charged through the transistor 84. When the anode voltage of the PUT 87 exceeds the gate voltage by this charging, the PUT 87 is rendered conductive. As a result, a pulse current flows through the primary coil of the pulse transformer 88. Then, a pulse is generated at the secondary coil of the pulse transformer 88 and is applied as a trigger pulse to the gate of the thyristor 32. The thyristor 32 is thus rendered conductive and lights up the exposure lamp 2. This trigger pulse is also applied to the gate of the thyristor 64 through the resistor 92 and the diode 93. The thyristor 64 is thus rendered conductive and generates a voltage corresponding to the voltage of the exposure lamp 2 at both ends of the resistor 65. The voltage generated in this manner is converted into a voltage corresponding to the effective voltage of the exposure lamp 2 by being shaped by the wave shaper 34 consisting of the diode 67, the resistors 68, 69, and 71, and the capacitor 70. This voltage is applied to the base of the transistor 72. When the base voltage of the transistor 72 is lower than the base voltage of the transistor 76, the collector voltage of the transistor 72 increases. Thus, the base voltage of the transistor 84 also increases, and the charging timing of the capacitor 85 is made faster. Since the PUT 87 generates pulses at faster timings, the conduction angle of the thyristor 32 is increased. Due to this, the voltage applied to the exposure lamp 2 increases and the amount of light increases. The change component due to an increase in the conduction angle of the thyristor 32 is fed back to the thyristor 64. As a result, the base voltage of the transistor 72 increases, and is balanced when it equals the base voltage of the transistor 76. Since the base voltage of the transistor 76 is held constant regardless of the variation in the voltage of the outlet 31, the base voltage of the transistor 72, that is, the voltage applied to the exposure lamp 2, is controlled so as to be constant. For changing the voltage applied to the exposure lamp 2, the base voltage (reference voltage) of the transistor 76 is varied.

A case is now considered wherein the adding switch 36 is set to on. The light emitted from the exposure lamp 2 is reflected by the manuscript, which is guided to the photosensitive drum 7, and part of the reflected light becomes incident on the photodiode 22. A photodetecting current of the photodiode 22 generated by the incident light is converted into a voltage by the operational amplifier 99 and the resistor 100 and is then amplified by the operational amplifier 102. The output voltage of the operational amplifier 102 is applied to the base of the transistor 72 through the adding switch 36. When the background of the manuscript is dark, the amount of the reflected light is small and the photodetecting current is also small, so that the base voltage is low. If the base voltage of the transistor 76 is higher than that of the transistor 72, the voltage applied to the exposure lamp 2 increases and the amount of light is controlled to increase. When the amount of light of the exposure lamp 2 increases, the amount of light reflected from the manuscript increases causing the output voltage of the photodetector 38 to increase and the base voltages of the transistors 72 and 76 to equal each other. When there is a variation in the voltage of the outlet 31 under this condition, the base voltages of the transistors 72 and 76 become unequal. Therefore, the base voltages of the transistors 72 and 76 are controlled to be equal, that is, the voltage applied to the exposure lamp 2 is controlled to be constant. Accordingly, the voltage applied to the exposure lamp 2 is controlled to be constant even when the outlet voltage varies so that the amount of light of the exposure lamp 2 automatically changes to keep the light incident on the photosensitive drum 7 constant. Due to this control, optimal exposure may be always obtained and an optimal copying operation may be performed. Further, since the change in the amount of light of the exposure lamp 2 due to variation in the outlet voltage is detected and compensated for, a stable operation is obtained regardless of the variation in the outlet voltage.

The operation of the limiter 40 will now be described. A voltage corresponding to the voltage applied to the exposure lamp 2 is obtained at the node of the resistors 68 and 69. The voltage thus obtained is supplied to the operational amplifier 106 which comprises a voltage follower and its output is smoothed and is applied to the operational amplifier 108 as a comparator. When the voltage applied to the exposure lamp 2 rises high as a result of a comparison, the input voltage of the operational amplifier 106 increases. Thus, the input voltage to the inverting input side of the operational amplifier 108 increases. When the increased input voltage exceeds the reference voltage set by the variable resistor 110 and the resistors 111 and 112, the operational amplifier 108 is turned on. The cathode voltage of the diode 115 takes a value which is obtained by dividing the voltage across the node 78 by the resistors 113 and 114. When the cathode voltage of the diode 115 is lower than the voltage of the node 82 minus the forward drop voltage of the diode 115, the voltage of the node 82, that is, the output voltage of the error amplifier 37, is limited. The voltage applied to the exposure lamp 2 is thus limited to a certain value. The reason why such a limiter 40 is incorporated may be summarized as follows. When an exposure lamp of a voltage rated lower than the commercial AC voltage is used, it is generally required to limit the voltage applied to the exposure lamp 2 so that it may not exceed the rated voltage for the service life. In this case, the limiter 40 as described above is required. When the manuscript is black when the adding switch 36 is set to on, or when the manuscript cover 1 is opened without placing a manuscript, the output voltage of the photodetector 38 takes a minimum value (about zero volt). Thus, the limiter 40 as described above is required. Furthermore, since the amount of light from the exposure lamp 2 is small and the output voltage of the photodetector 38 is low immediately after the lamp is turned on, the limiter 40 as described above is required.

Figure 4:
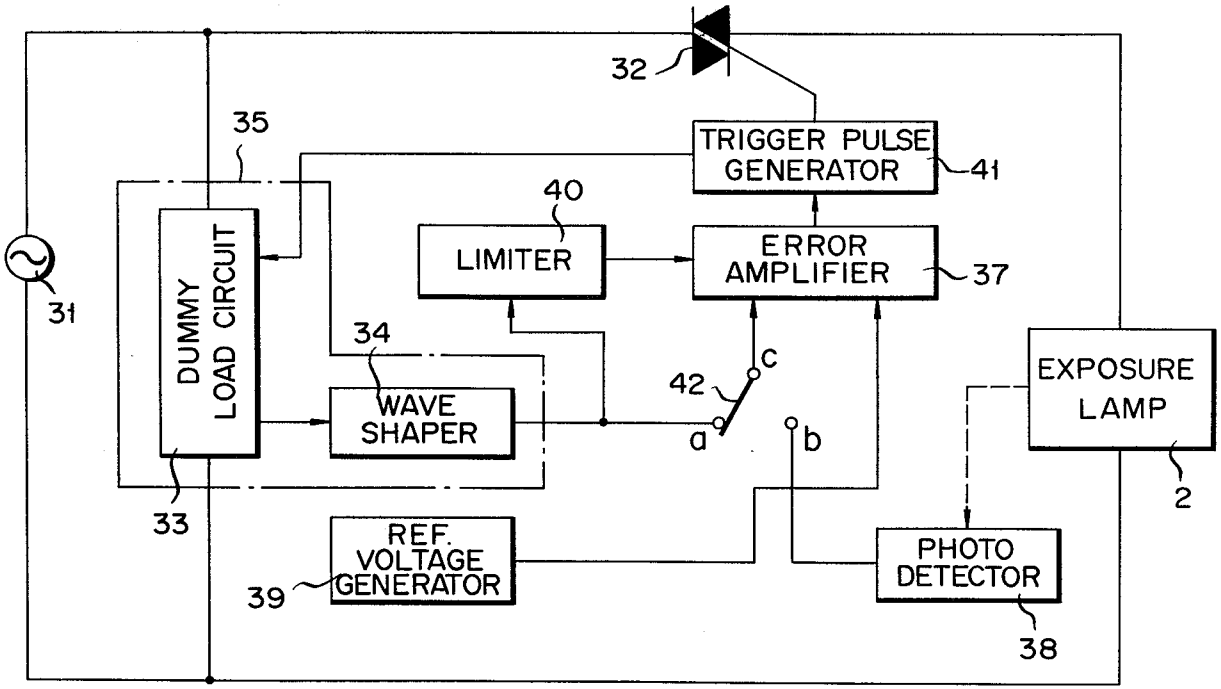
FIG. 4 is a block diagram illustrating the exposure control device shown in FIG. 2 according to another embodiment of the present invention.

FIG. 4 shows another embodiment of the present invention. The same parts are designated by the same reference numerals and their description will be omitted. In this embodiment, the output voltage of the wave shaper 34 is supplied to a comparator, for example, the error amplifier 37 through the side a of a selection switch 42, as a selection circuit. The output voltage of the photodetector 38 is supplied to the error amplifier 37 through the side b of the selection switch 42. Thus, the error amplifier 37 compares the output voltage of the wave shaper 34 or the photodetector 38 with the reference voltage of the reference voltage generator 39, and outputs a signal corresponding to the error when there is an error between the voltages.

With an exposure control device of this construction, when the selection switch 42 is set to the side a, it is under the same condition as the adding switch 36 is set to the off position in the embodiment shown in FIG. 2 and the same kind of control operation is performed. When the selection switch 42 is set to the side b, the error amplifier 37 compares the output voltage of the photodetector 38 with the reference voltage of the reference voltage generator 39. In the detailed circuit diagram shown in FIGS. 3A and 3B, a first stationary contact 42*a* of the switch 42 is connected to the output terminal of the wave shaper 34 through the resistor 69. A movable contact 42*c* of the selection switch 42 is connected to the base of the npn transistor 72. A second stationary contact 42*b* of the selection switch 42 is connected to the output end of the operational amplifier 102 of the photodetector 38 through the variable resistor 105. The connection is the same as that shown in FIGS. 3A and 3B except as described above. The same effects obtained with the embodiment shown in FIG. 2 are obtainable with this construction.

What is claimed is:

1. An exposure control device for a photocopier which exposes an image by irradiating a manuscript with an exposure lamp and guiding the reflected light to a photosensor comprising, (a) voltage generating means for generating a voltage corresponding to a voltage applied to said exposure lamp;

(b) light detecting means for detecting the light reflected from said manuscript for converting it into a voltage signal;

(c) means for adding an output voltage of said light detecting means to an output voltage of said voltage generating means;

(d) comparing means for comparing a voltage added by said adding means with a reference voltage set in advance, and for outputting a signal corresponding to the compared result; and (e) control means for controlling the amount of light from said exposure lamp according to the output signal from said comparing means.

2. An exposure control device for a photocopier which exposes an image by irradiating a manuscript with an exposure lamp and guiding the reflected light to a photosensor comprising, (a) voltage generating means for generating a voltage corresponding to a voltage applied to said exposing lamp;

(b) light detecting means for detecting the light reflected from said manuscript for converting it into a voltage signal;

(c) means for selecting an output voltage of said light detecting means or an output voltage of said voltage generating means;

(d) comparing means for comparing a voltage selected by said selecting means with a reference voltage set in advance, and for outputting a signal corresponding to the compared result; and (e) control means for controlling the amount of light from said exposing lamp according to the output signal from said comparing means.

3. An exposure control device for a photocopier for exposing an image by irradiating a manuscript with an exposure lamp and guiding the reflected light to a photosensor comprising:

(a) a power source;

(b) thyristor means for supplying said power source to said exposure lamp for a predetermined period of time;

(c) dummy load circuit means to which is applied a voltage corresponding to a voltage across both ends of said exposure lamp and which outputs a voltage across both ends of the dummy load;

(d) wave shaping means for shaping the waveform of an output voltage of said dummy load circuit means for outputting a voltage corresponding to an effective voltage of said exposure lamp;

(e) photodetecting means for detecting the light reflected from said manuscript and for outputting a voltage signal corresponding to the amount of detected light;

(f) adding switching means for adding an output voltage of said photodetecting means to an output voltage of said wave shaping means;

(g) reference voltage generating means for generating a reference voltage for comparison;

(h) error amplifying means for comparing the voltage added at said adding switching means with an output voltage of said reference voltage generating means and for outputting a signal corresponding to the compared result; and (i) trigger pulse generating means for supplying a trigger pulse to said thyristor means and to said dummy load circuit means so as to control the amount of light from said exposure lamp according to an output signal of said error amplifying means.

4. An exposure control device for a photocopier for exposing an image by irradiating a manuscript with an exposure lamp and guiding the reflected light to a photosensor comprising:

(a) a power source;

(b) thyristor means for supplying said power source to said exposure lamp for a predetermined period of time;

(c) dummy load circuit means to which is applied a voltage corresponding to a voltage across both ends of said exposure lamp and which outputs a voltage across both ends of the dummy load;

(d) wave shaping means for shaping the waveform of an output voltage of said dummy load circuit means for outputting a voltage corresponding to an effective voltage of said exposure lamp;

(e) photodetecting means for detecting the light reflected from said manuscript and for outputting a voltage signal corresponding to the amount of detected light;

(f) selecting switching means for selecting an output voltage of said photodetecting means or an output voltage of said wave shaping means;

(g) reference voltage generating means for generating a reference voltage for comparison;

(h) error amplifying means for comparing the voltage selected by said selecting switching means with an output voltage of said reference voltage generating means and for outputting a signal corresponding to the compared result; and (i) trigger pulse generating means for supplying a trigger pulse to said thyristor means and to said dummy load circuit means so as to control the amount of light from said exposure lamp according to an output signal of said error amplifying means.

5. An exposure control device for a photocopier according to claim 3 or 4, further comprising, limiter means for limiting an output of said error amplifying means when an output voltage of said wave shaping means exceeds a predetermined value so that the voltage applied to said exposure lamp may not exceed the rated voltage.

6. An electronic photocopier comprising, (a) a photosensor;

(b) a charger for charging said photosensor;

(c) an exposure device for forming an electrostatic latent image of an optical signal on said photosensor by irradiating a manuscript with an exposure lamp and guiding the light reflected therefrom to said photosensor;

(d) a voltage generator for generating a voltage corresponding to a voltage to be applied to said exposure lamp;

(e) a photodetector for detecting light reflected from said manuscript and converting it into an electric signal;

(f) means for adding an output voltage of said photodetector to an output voltage of said voltage generator;

(g) a comparator for comparing a voltage added by said voltage adding means with a preset reference voltage and for outputting a signal corresponding to the compared result;

(h) a control circuit for controlling the amount of light of said exposure lamp in response to an output signal of said comparator;

(i) a developer for developing an electrostatic latent image formed on said photosensor; p1 (j) a copying device for copying the visual image formed on said photosensor on a recording paper sheet; and (k) a fixing device for fixing the visual image copied on said recording paper sheet.

7. An electronic photocopier comprising, (a) a photosensor;

(b) a charger for charging said photosensor;

(c) an exposure device for forming an electrostatic latent image of an optical signal on said photosensor by irradiating a manuscript with an exposure lamp and guiding the light reflected therefrom to said photosensor;

(d) a voltage generator for generating a voltage corresponding to a voltage to be applied to said exposure lamp;

(e) a photodetector for detecting light reflected from said manuscript and converting it into an electric signal;

(f) means for selecting an output voltage of said photodetector or an output voltage of said voltage generator;

(g) a comparator for comparing a voltage selected by said selecting means with a preset reference voltage and for outputting a signal corresponding to the compared result;

(h) a control circuit for controlling the amount of light of said exposure lamp in response to an output signal of said comparator;

(i) a developer for developing an electrostatic latent image formed on said photosensor;

(j) a copying device for copying the visual image formed on said photosensor on a recording paper sheet; and (k) a fixing device for fixing the visual image copied on said recording paper sheet.

* * * * *